US005196884A

United States Patent [19]

Sugiyama et al.

[11] Patent Number: 5,196,884

[45] Date of Patent: Mar. 23, 1993

[54] APPARATUS HAVING A PLURALITY OF REPLACEABLE PARTS

[75] Inventors: Toshihiro Sugiyama, Yokohama; Toshihiko Takaya, Matsudo, both of Japan

[73] Assignee: Ricoh Company, Ltd., Tokyo, Japan

[21] Appl. No.: 591,373

[22] Filed: Oct. 1, 1990

[30] Foreign Application Priority Data

Oct. 2, 1989 [JP] Japan ..... 1-116103[U]
Aug. 2, 1990 [JP] Japan ..... 2-205625

[51] Int. Cl.[5] ..... G03G 21/00

[52] U.S. Cl. ..... 355/200; 355/202; 355/208; 355/210; 355/260

[58] Field of Search ..... 355/202, 211, 200, 208, 355/210, 260

[56] References Cited

U.S. PATENT DOCUMENTS 4,912,563 3/1990 Narita ..... 355/200 X
4,974,020 11/1990 Takamatsu et al. ..... 355/245 X
5,017,962 5/1991 Tsuji et al. ..... 355/210
5,051,778 9/1991 Watanabe et al. ..... 355/200

FOREIGN PATENT DOCUMENTS 0143360 7/1985 Japan .
0166960 8/1985 Japan .
0193157 8/1988 Japan .
0189668 7/1989 Japan .

*Primary Examiner*—A. T. Grimley
*Assistant Examiner*—Matthew S. Smith
*Attorney, Agent, or Firm*—Oblon, Spivak, McClelland, Maier & Neustadt

[57] ABSTRACT

An apparatus having a plurality of replaceable parts. Replaceable parts to which the same life is assigned beforehand are replaced at the same time by hand or by use of a jig. Lives which are integral multiples of the shortest life which one of the replaceable parts has each is assigned to respective one of the other replaceable parts. Hence, when the life of a certain part has expired, the part having the shortest life is automatically replaced together with the part whose life has expired. The replaceable parts each is mounted on and locked to the apparatus and, when the life thereof has expired, unlocked from the apparatus. The expiration of the life is detected either electrically or mechanically, and the parts reached the end of the life is indicated. Before the life of a replaceable part expires, a spare part for replacing it is prepared by detecting that the life is about to expire. The deterioration of a part having a comparatively long life is measured to correct the time for replacing it.

2 Claims, 15 Drawing Sheets

APPARATUS HAVING A PLURALITY OF REPLACEABLE PARTS

BACKGROUND OF THE INVENTION

The present invention relates to an apparatus having a plurality of replaceable parts each having a particular service life and, more particularly, to an electrophotographic image recording apparatus.

Various parts constituting a single apparatus each has a particular rate of composition, i.e. a service life. Assume an apparatus in which all the parts are individually fixed in position and not removable from the apparatus. Then, when one of the parts whose life is shortest fails to serve the function assigned thereto, the apparatus has to be bodily discarded or needs a thorough overhaul despite that the other parts having comparatively long lives are still usable. A current trend in various fields is, therefore, toward an apparatus which is constituted by a plurality of replaceable parts. Especially, in the electrophotographic imaging art, a printer, facsimile machine, copier or similar image recording apparatus made up of a plurality of replaceable parts each having a particular life has been proposed in various forms. In an electrophotographic copier, for example, various replaceable parts such as a main charger, toner cartridge, developing unit, transfer charger and a cleaning unit which are different in life are arranged around a photoconductive drum. These parts each is determined to have reached its life and replaced when the copier has been operated for a predetermined period of time or has produced a predetermined number of copies, i.e. a running number. For example, the life in terms of the running number is predetermined to be 1,000 for the toner cartridge, 4,000 for the developing unit, 8,000 for the nain and transfer chargers, 16,000 for the cleaning unit, and 32,000 for the drum. More specifically, the lives each is an integral multiple of the life of the toner cartridge which is shorter than the others. Hence, before the drum is replaced once, the cleaning unit, main and transfer chargers, developing unit and toner cartridge have to be replaced twice, four times, eight times, and thirty-two times, respectively. Such replaceable parts are removably mounted on an apparatus body independently of one another (e.g. Japanese Patent Laid-Open Publication No. 166960/1985). This kind of scheme has a drawback that used parts have to be removed from the apparatus body and replaced with new parts one by one, resulting in inefficient replacement. Moreover, it is likely that the operator forgets to remove some of the used parts from the apparatus body.

SUMMARY OF THE INVENTION

It is therefore an object of the present invention to provide an apparatus having a plurality of replaceable parts which promotes efficient replacement of the replaceable parts while preventing any of them from being left non-replaced thereinside.

It is another object of the present invention to provide a generally improved apparatus having a plurality of replaceable parts.

In accordance with the present invention, an apparatus has a plurality of replaceable parts each having a particular life, lives which are integral multiples of the shortest life which one of the replaceable pats has each being assigned to respective one of the replaceable parts beforehand, and a plurality of fixing members each for fixing together, among the replaceable parts, those to which the same life is assigned while being mounted on the apparatus, whereby the plurality of fixing members are selectively removed for replacing the replaceable parts to which the same life is assigned.

Also, in accordance with the present invention, an apparatus has a plurality of replaceable parts each having a particular life, lives which are integral multiples of the shortest life which one of the replaceable parts has each being assigned to respective one of the replaceable parts beforehand, and a plurality of replacing members each for replacing, among the replaceable parts mounted on the apparatus, those to which the same life is assigned at the same time.

Further, in accordance with the present invention, an apparatus has a plurality of replaceable parts each having a particular life, a plurality of locking members each being associated with respective one of the replaceable parts mounted on the apparatus for locking the replaceable part, a detecting device for determining that the life of any of the locked replaceable parts has expired, and a plurality of unlocking members each being associated with respectively one of the replaceable parts for unlocking the replaceable part when the detecting device has determined that the life of the replaceable part has expired.

Furthermore, in accordance with the present invention, an apparatus has a plurality of replaceable parts each having a particular life, lives which are N (N=1, 2, 3 . . . ) times longer than the shortest life which one of the replaceable parts has each is assigned to respective one of the replaceable part, a counting device for counting the number of times that the replaceable part having the shortest life is replaced, a detecting device for detecting, when the counting device has reached N, that the life of the replaceable parts having the N times longer life has expired, and an indicating device for indicating the replaceable parts whose life has expired.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENTS

Preferred embodiments of the apparatus in accordance with the present invention and implemented as an electrophotographic image recording apparatus will be described.

Figure 1:
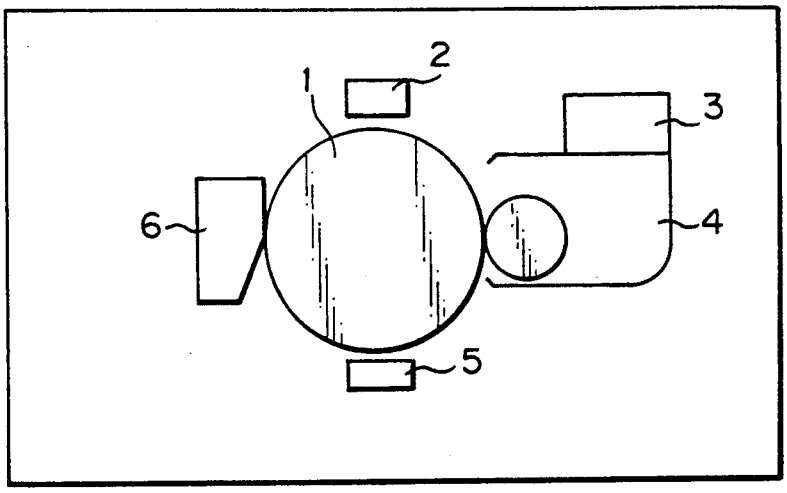
FIG. 1 is a section showing replaceable parts arranged around a photoconductive drum in an image recording apparatus to which the present invention is applicable.

FIG. 1 shows an image recording apparatus having a photoconductive drum 1 and various replaceable parts arranged therearound such as a main charger 2, a developing unit 4, a transfer charge 5, a cleaning unit 6, and a discharge lamp, not shown. The main charger 2 charges the drum 1 in the dark by corona discharge. While a toner is fed from a toner cartridge 3 to the developing unit 4, the unit 4 deposits it on a latent image electrostatically formed on the drum 1 by imagewise exposure, thereby forming a toner image on the drum 1. The transfer charger 5 transfers the toner image to a paper sheet being held in contact with the drum 1, by applying a charge from the back of the paper sheet. After the image transfer, the cleaning unit 6 dissipates the charge from the toner remaining on the drum 1 with a fur brush and then scrapes it off with a cleaning blade. The discharge lamp, not shown, illuminates the entire periphery of the cleaned drum 1 to expel the charge remaining on the drum 1.

The lives of the individual parts mentioned above are set in terms of the running number, as stated earlier. Specifically, the running number selected to be 1,000 for the toner cartridge 3, 16,000 for the cleaning unit 6, 4,000 for the developing unit 4, 8,000 for both the main charger 2 and transfer charger 5, and 32,000 for the drum 1. The discharge lamp is not a replaceable part since it has a long service life, compared to the others. In this condition, it is necessary to replace the main charger 2 and transfer charger 5 four times, the developing unit 4 eight times, the cleaning unit two times, and the toner cartridge 3 thirty-two times before the replacement of the drum 1.

Figure 2:
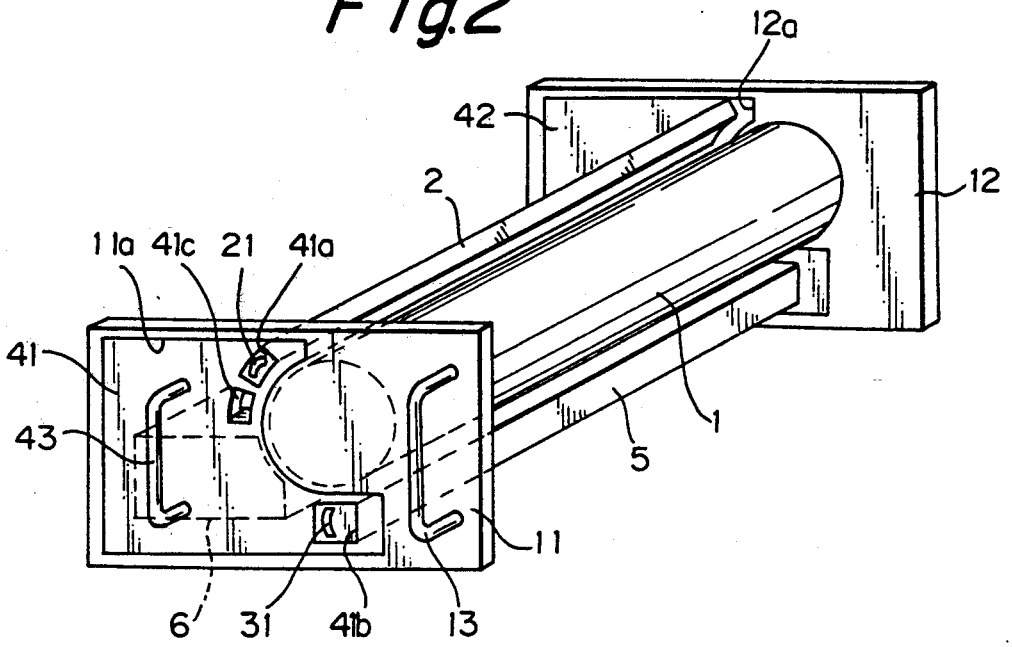
FIG. 2 is a fragmentary perspective view of a first embodiment of the image recording apparatus in accordance with the present invention.
Figure 3:
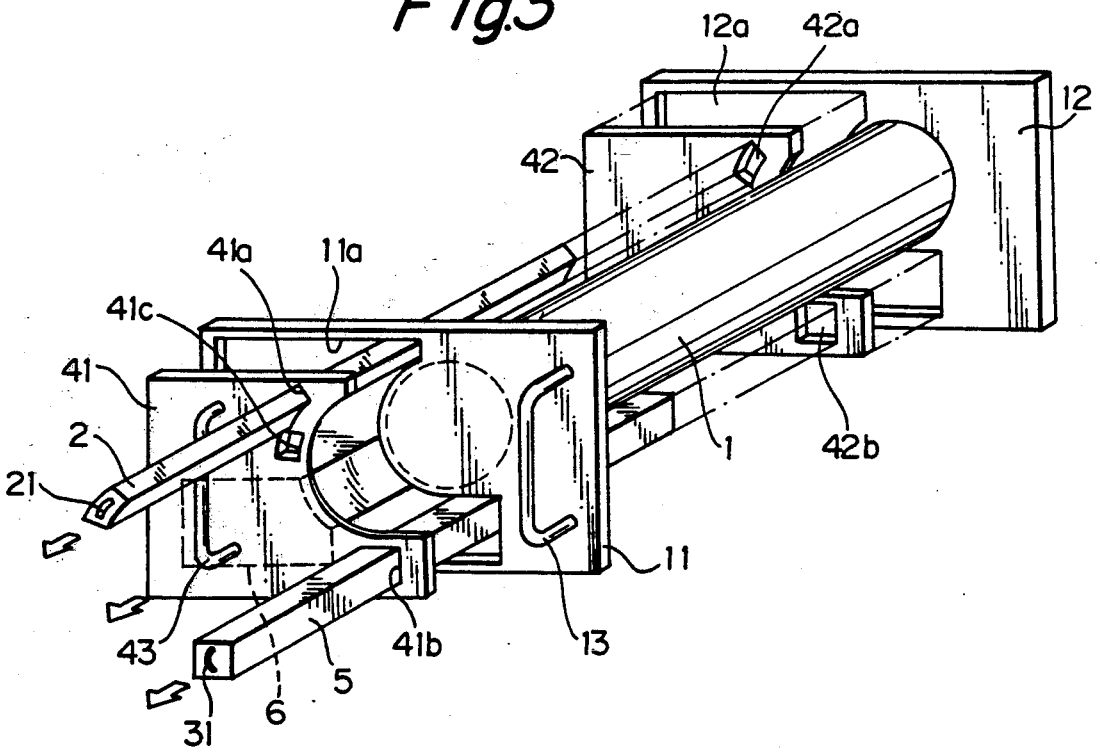
FIG. 3 is a perspective view showing how the parts of the apparatus shown in FIG. 2 are removed.

Referring to FIGS. 2 and 3, an image recording apparatus having a plurality of replaceable parts and representative of a first embodiment of the present invention is shown. The replaceable parts each has a particular service life, as stated above. As shown, the drum 1 is affixed at the front and rear ends thereof to a front and a rear main plate 11 and 12, respectively. This drum and plate assembly is removably inserted into the apparatus in the axial direction of the drum 1 through an opening which is formed through the front wall of the apparatus body, the rear plate 12 is engaged with a stationary guide provided on the apparatus body and thereby settles the assembly in a predetermined position. The cleaning unit 6 is affixed at the front and rear ends thereof to a front and a rear auxiliary plate 41 and 42, respectively. When the cleaning unit 6 is mounted on the apparatus body, the front auxiliary plate 41 closes an opening 11*a* which is formed through the front main plate 11. The rear auxiliary plate 42 is dimensioned smaller than the front auxiliary plate 41 so that it may pass through the opening 11*a* The plate 42 passed through the opening 11*a* is engaged with a recess 12*a* which is formed in the rear main plate 12, whereby the cleaning unit 6 is positioned. The front auxiliary plate 41 has holes 41*a* and 41*b* for receiving the main and transfer chargers 2 and 5, respectively, and a hole 41*c* for receiving the discharge lamp, not shown. The hole 41*c* is located in close proximity to the holes 41*a* and 41*b*. The rear auxiliary plate 42 has recesses 42*a* and 42*b* for receiving the rear ends of the chargers 2 and 5, respectively, and a hole, not shown, for receiving the discharge lamp. Knobs 13 and 43 are provided on the front main and auxiliary plates 11 and 41, respectively. Knobs 21 and 31 are provided on the front ends of the chargers 2 and 5, respectively.

In the above construction, the chargers 2 and 5 having the same predetermined service life are mounted on the cleaning unit 6 whose service life is double the service life of the former. The cleaning unit 6 is in turn mounted on the drum 1 having a twice longer life than the cleaning unit 6. The drum 1 having the longest life is mounted on the apparatus body, not shown.

Assume that the apparatus has reached the running number of 8,000 and urged a person to replace the chargers 2 and 5. The, the person can readily pull out the chargers 2 and 5 by holding the knobs 21 and 31 and replace them independently of the other parts since the cleaning unit 6 remains on the drum 1 and since the drum 1 remains on the apparatus body. When the cleaning unit 6 reaches the time for replacement, both of the chargers 2 and 5 has reached the time for second replacement. As one pulls out the cleaning unit 6 by holding the knob 43, the rear auxiliary plate 42 pushes out the chargers 2 and 5 with the drum 1 remaining on the apparatus body alone. This allows the three parts to be removed and replaced at the same time. At the time when the drum 1 needs replacement, the chargers 2 and 5 have reached the time for fourth replacement while the cleaning unit 6 has reached the time for second replacement. As one pulls out the drum by holding the knob 13, the rear main plate 12 pushes out the cleaning unit 6 while the rear auxiliary plate 42 of the cleaning unit 6 pushes out the chargers 2 and 5.

The various replaceable parts stated above may be grouped on a life basis and painted in different colors in portions thereof which are visible from the outside. For example, the front ends of the chargers 2 and 5, the front end of the front auxiliary plate 41 of the cleaning unit 6, and the front end of the from main plate 11 may be painted in different colors. This will allow one to readily recognize the parts which should be replaced together and will thereby promote efficient replacement.

Figure 4:
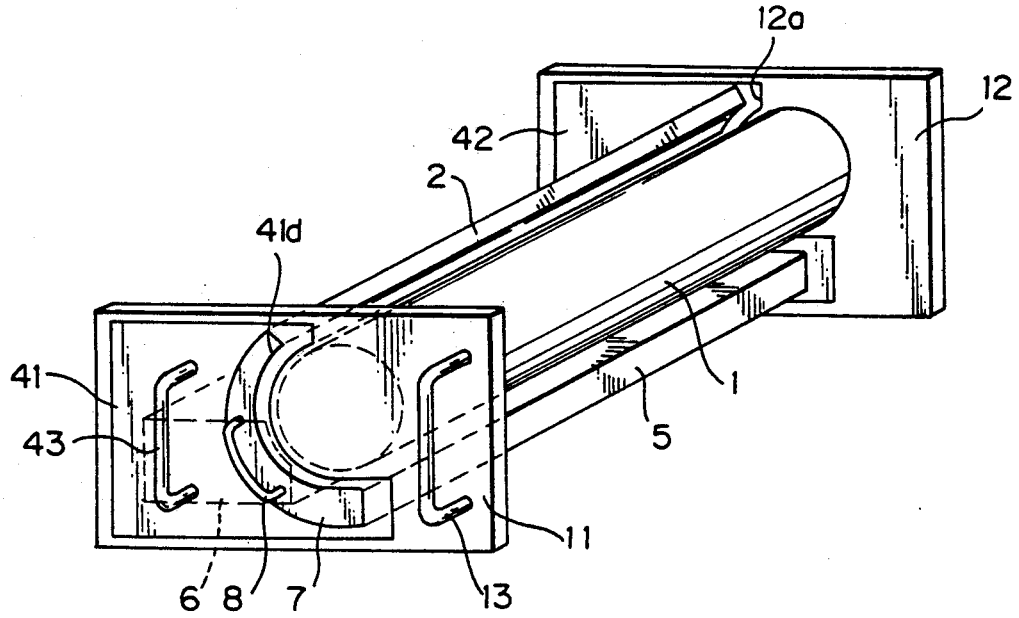
FIG. 4 is a perspective view showing a second embodiment of the present invention.
Figure 5:
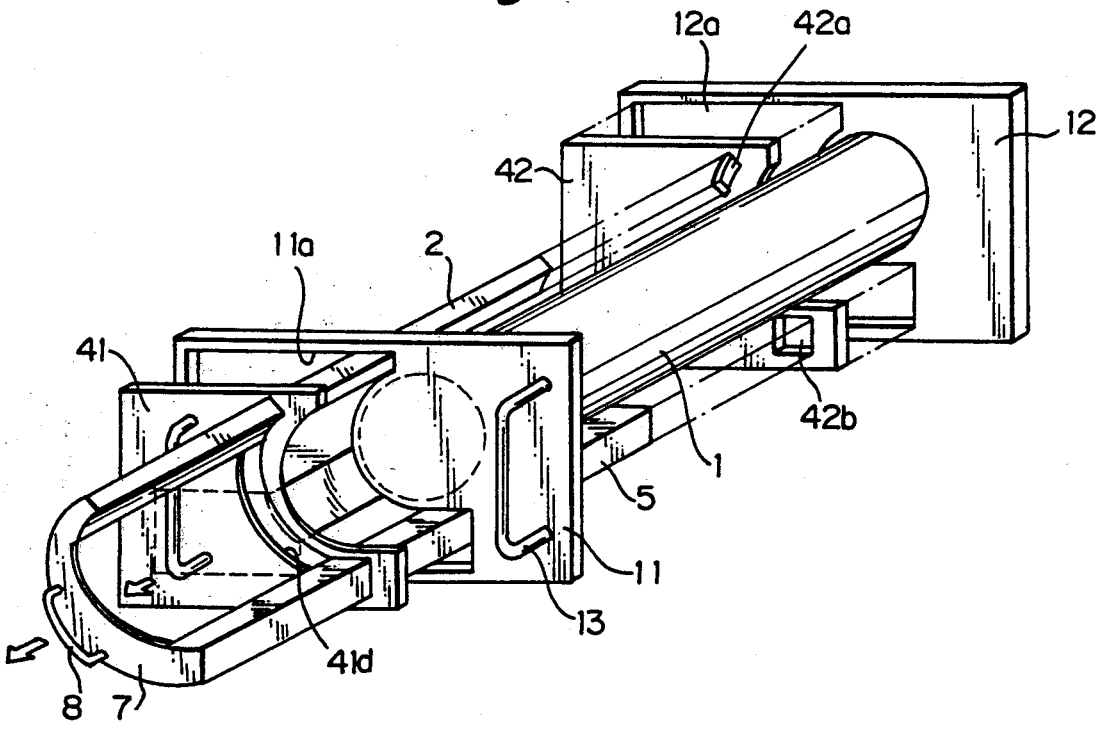
FIG. 5 is a perspective view showing how the parts of the apparatus shown in FIG. 2 are removed.

FIGS. 4 and 5 show a second embodiment of the present invention. In the figures, the same or similar components are designated by like reference numerals, and redundant description will be avoided for simplicity. In this particular embodiment, the main and transfer chargers 2 and 5 having the same life are connected together by a joint 7 which is provided with a knob 8. Such a configuration allows one to remove both of the chargers 2 and 5 at the same time by pulling the knob 8. An arcuate slot 41*d* is formed through the front auxiliary plate 41 of the cleaning unit 6 in place of the holes 41*a* and 41*b* of the first embodiment. When some groups of replaceable parts each having the same life exist, this embodiment will promote extremely efficient replacement.

In the embodiments described above, replaceable parts having the same life are fixed together to be replaced at the same time, or a first replaceable part having a particular life is removably mounted on a second replaceable part having a twice longer life than the first part. Hence, when the second part is pulled out for replacement, the first part is pulled out at the same time.

While the first and second embodiments have concentrated on a configuration wherein the individual replaceable parts are pulled out in the longitudinal direction thereof, they are similarly applicable to a configuration wherein the parts are pulled out in a direction perpendicular to the longitudinal direction. Specifically, the replaceable parts may be removed from above the apparatus by opening an upper cover provided on the apparatus. Of course, in such a case, the upper portions of the individual parts should advantageously be painted for discrimination. In the illustrative embodiments, the chargers 2 and 5 and the cleaning unit 6 are respectively engaged with the cleaning unit 6 and the drum 1 at their rear ends. Alternatively, such parts may each be provided with a protuberance at the front end thereof.

Figure 6:
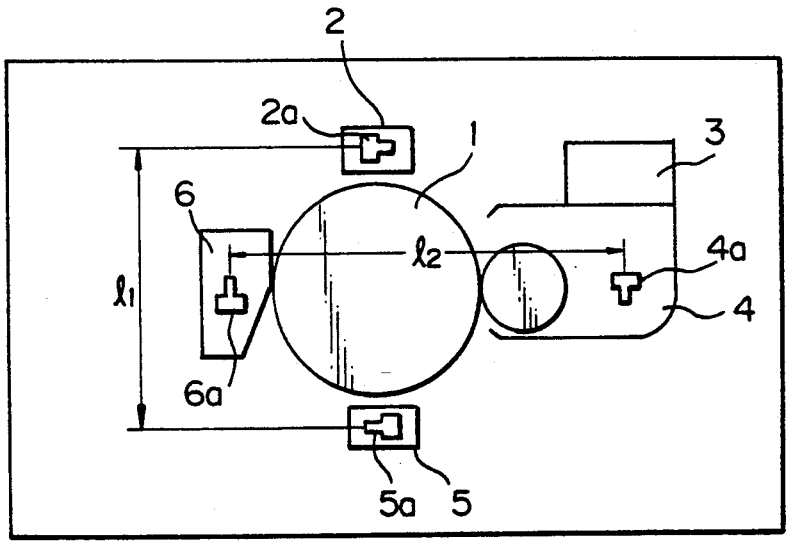
FIG. 6 is a view showing a third embodiment of the present invention.
Figure 8:
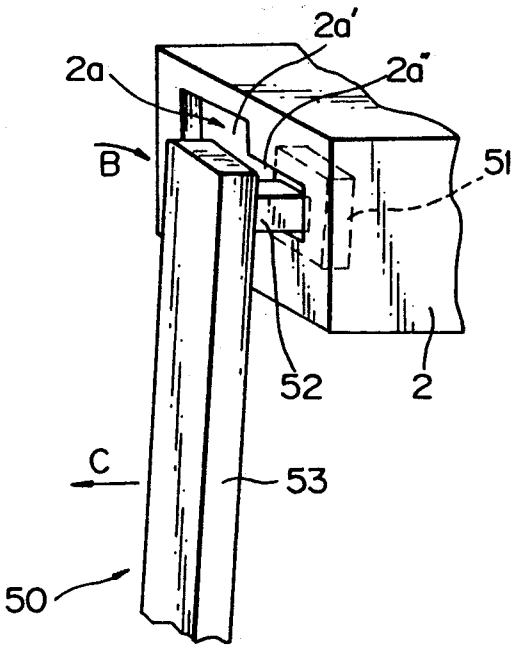
FIG. 8 is a perspective view showing the part and the jig of the illustrative embodiment in a mated condition.
Figure 7:
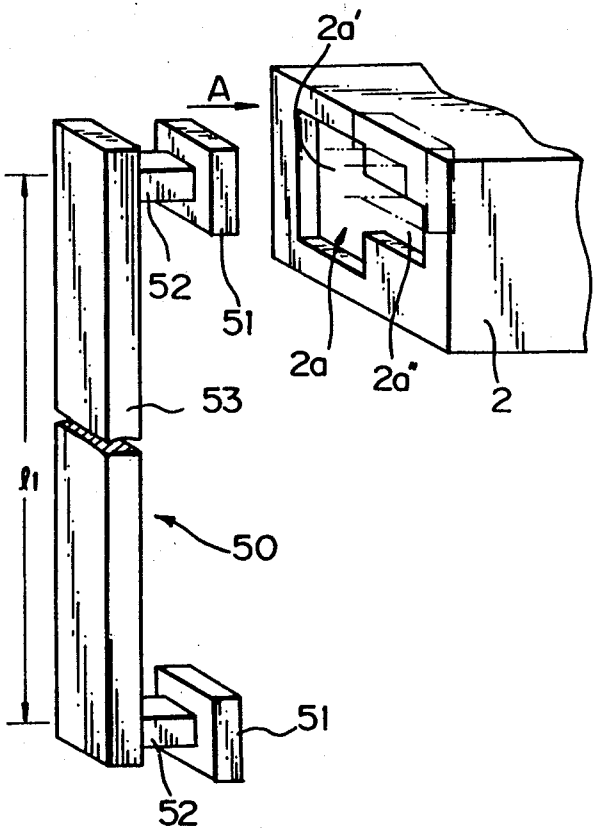
FIG. 7 is a perspective view indicative of a relation between particular one of the parts included in the third embodiment and a jig for replacement.

A third embodiment of the present invention will be described with reference to FIGS. 6 to 8. Assume that, among the various replaceable parts shown in FIG. 6, the main and transfer chargers 2 and 5 live for the same period while the developing unit 4 and cleaning unit 6 live for the same period which is different from the life of the chargers 2 and 5. Generally T-shaped recesses 2*a* and 5*a* having identical dimensions are formed in the outermost ends of the chargers 2 and 5, respectively, and oriented in opposite directions in the right-and-left direction. Likewise, generally T-shaped recesses 4*a* and 6*a* having identical dimensions are formed on the outermost ends of the developing and cleaning units 4 and 6, respectively, and oriented in opposite directions in the up-and-down direction. The distance $l_1$ between the recesses 2*a* and 5*a* and the distance $l_2$ between the recesses 4*a* and 6*a* are different from each other. A jig 50 fore replacement is prepared and has a bar 53, lugs 52 extending out from opposite ends of the bar 53, and locking pieces 51 each being provided on the tip of respective one of the lugs 52. The locking pieces 51 are spaced apart from each other by a distance $l_1$ so that they may enter the recesses 2*a* and 5*a* at the same time. As shown in FIG. 7, the recess 2*a* has a greater position 2*a*∝ and a smaller portion 2*a*″ which are contiguous with each other. The other recess 5*a* also has a greater portion and a smaller portion, although not shown in the figure. When the life of the chargers 2 and 5 expires, the locking pieces 51 each is inserted into respective one of the greater portions (only 2*a*′ is visible) of the recesses 2*a* and 5*a* in a direction indicated by an arrow A in FIG. 7. Subsequently, the jig 50 is bodily rotated in a direction indicated by an arrow B in FIG. 8. As a result, the lugs 52 each mates with respective one of the smaller portions (only 2*a*″ is shown) of the recesses 2*a* and 5*a*, thereby locking the jig 50 to the chargers 2 and 5. When the jig 50 so locked to the chargers 2 and 5 is pulled in a direction C as shown in FIG. 8, the chargers 2 and 5 are pulled out at the same time. Likewise, the developing and cleaning units 4 and 6 can be removed at the same time if use is made of a jig having locking pieces which are spaced apart by the distance $l_2$. The distances $l_1$ and $l_2$ of such locking pieces should preferably be different from each other to prevent parts other than those which have to be replaced from being removed.

Figure 9:
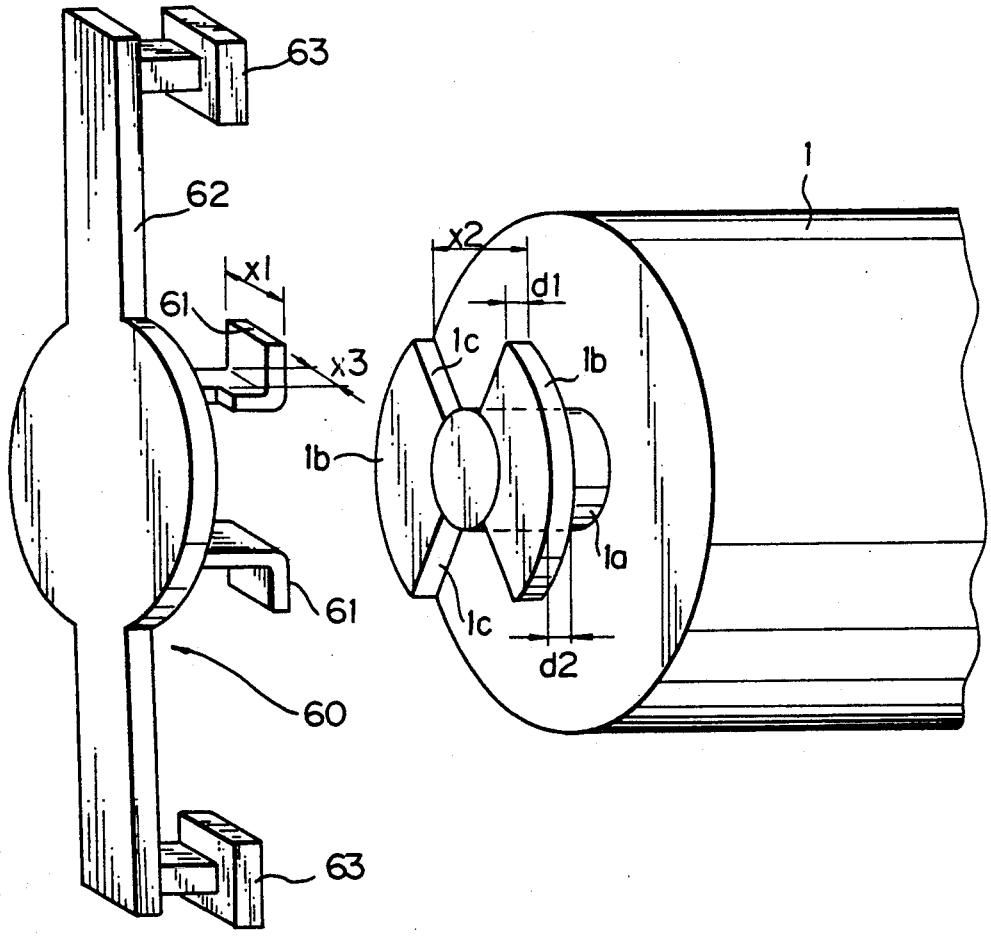
FIG. 9 is a fragmentary perspective view of a fourth embodiment of the present invention.

FIG. 8 shows a fourth embodiment of the present invention which allows the drum 1 whose life is longest to be removed together with the parts which are shorter in life and have reached the time for replacement. As shown, a shaft 1*a* extending on the axis of the drum 1 protrudes from the outermost end of the drum 1. A pair of radially outwardly extending flanges 1*b* are provided on the protruding end of the shaft 1*a* and positioned symmetrically to each other with respect to the shaft 1*a*. The flanges 1*b*, therefore, define a pair of symmetrical gaps 1*c* therebetween. On the other hand, a jig 60 has a bar 62 which has at opposite ends thereof locking pieces 63 engageable with the main and transfer chargers 2 and 5, and a pair of pawls 61 extending out from an intermediate portion of the bar 62 to enter the gaps 1*c* of the drum 1. As shown in FIG. 9, the pawls 61 each has a portion whose width is $x_1$ and a portion whose width is $x_3$, while the recesses 1*c* has a width $x_2$. These widths are related as $x_2 > x_1 > x_3$. When the life on the drum 1 expires, the jig 60 is positioned such that the pawls 61 enter the gaps 1*c* of the drum 1 and the locking pieces 63 mate with the greater portions of the recesses 2*a* and 5*a* of the charges 2 and 5. Then, the jib 60 is bodily rotated clockwise as viewed in FIG. 9. In this condition, the jib 60 is locked to the drum 1 and chargers 2 and 5, allowing the latter to be removed at the same time. Assume that the flanges 1*b* of the drum 1 have thicknesses $d_1$ and $d_2$ which are different from each other. Then, the thickness $d_2$ may be selected to be greater than the thickness $d_1$ in order to cause the pawls 61 to bite more firmly into the flanges 1*b*.

Figure 10:
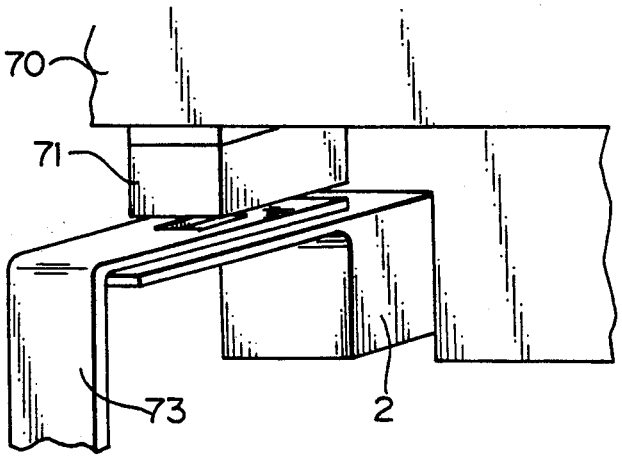
FIG. 10 is a fragmentary perspective view showing a fifth embodiment of the present invention.
Figure 11:
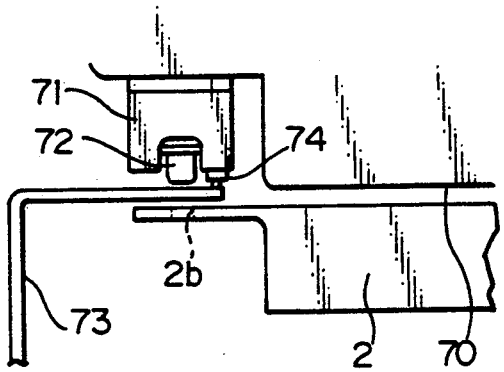
FIG. 11 is a side elevation of the fifth embodiment.
Figure 12:
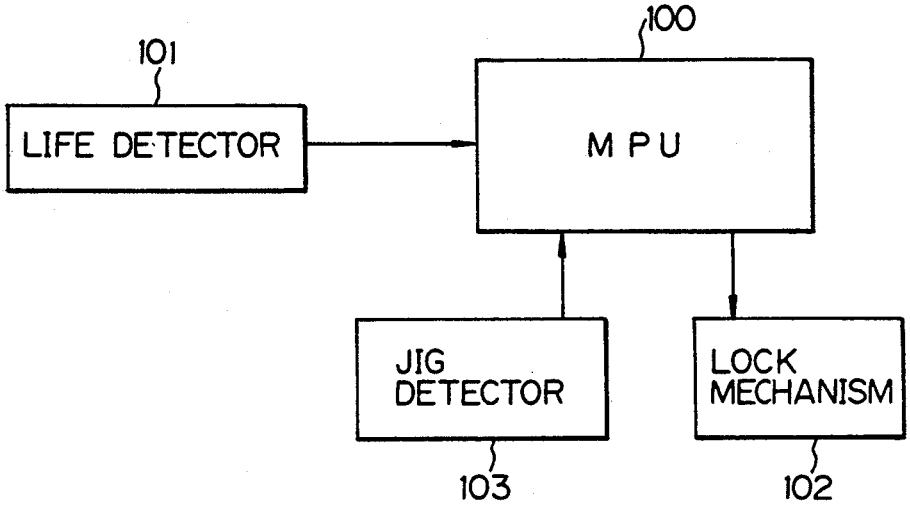
FIG. 12 is a schematic block diagram showing a control system associated with the fifth embodiment.

Referring to FIGS. 10 to 12, a fifth embodiment of the present invention is shown. In this particular embodiment, the image recording apparatus has a mechanism for locking a particular replaceable part on the body thereof and, when the life of the part expires, unlocks it. Specifically, the apparatus body 70 has an electromagnet 71 for locking and unlocking the main and transfer chargers 2 and 5 or similar replaceable parts (only the main charger 2 is shown). When the charger 2 is mounted on the apparatus body 70, the electromagnet 71 is deenergized to cause a locking pin 72 to protrude due to a biasing force constantly acting thereon. In this condition, the locking pin 72 is received in a hole 2*b* which is formed through the charger 2, whereby the charger 2 is firmly held on the apparatus body 70.

As the life of the charger 2 expires, a life detector 101 shown in FIG. 12 delivers a signal to a microprocessing unit (MPU) 100. In response, the MPU 100 energizes the electromagnet 71 with the result that the locking pin 72 is pulled out of the hole 2*b* against the biasing force. This causes a locking mechanism 102, FIG. 12, to unlock the charger 2. Thereafter, a jig 73 is inserted to a position shown in FIG. 11. Then, a locking mechanism, not shown, provided on the jig 73 is actuated to lock the jib 73 to the charger 2 and thereby allows the charger 2 to be pulled out together with the jig 73. Such a mechanism may also be provided on the transfer charger 5 in order to remove it together with the main charge 2.

As shown in FIG. 11, a reflection type photosensor 74 may be affixed to the electromagnet 71, while the jib 73 may be provided with a channel for receiving the locking pin 72. Such a configuration allows the jig 73 to be inserted into the apparatus body with the locking pin 72 remaining in the locking position. When the photosensor 74 senses the jig 73, a jig detector 103, FIG. 12, generates a signal for causing the locking pin 72 to retract from hole 2*b* of the charger 2. This kind of configuration allows a single jig to automatically select and remove only the replaceable part whose life has expired. If desired, the above-described locking mechanism may be provided on the apparatus body 70, and a replaceable part may be constantly biased by a spring or similar biasing means toward the outside and automatically unlocked when its life expires. Then, only the part of interest will be automatically protruded from the body 70 and can be easily removed without resorting to a jig.

Figure 13:
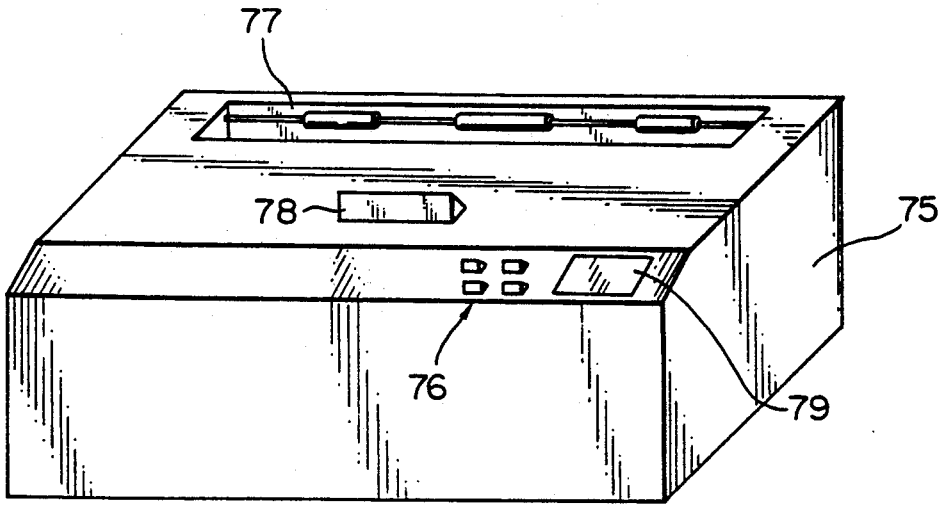
FIG. 13 is a perspective view showing a sixth embodiment of the present invention.
Figure 14:
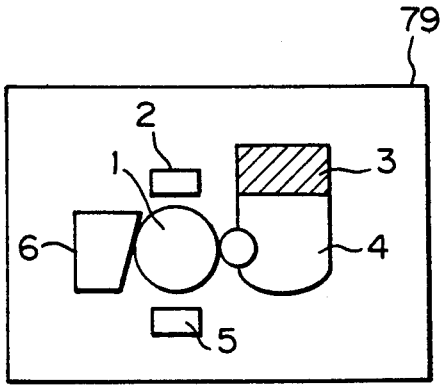
FIGS. 14 to 17 are views each showing a particular condition of a display panel included in the sixth embodiment.
Figure 15:
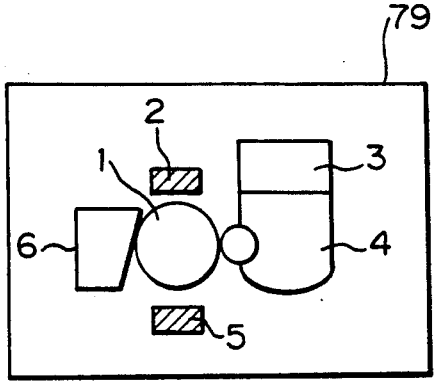
Figure 16:
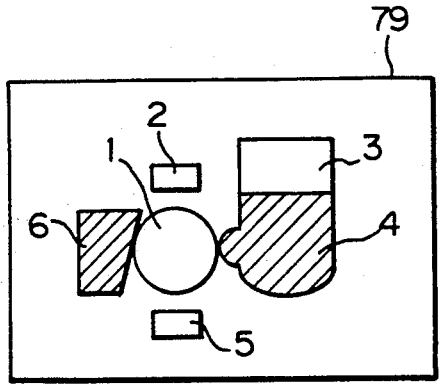
Figure 17:
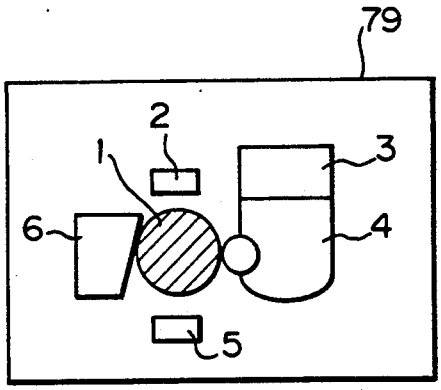

FIG. 13 shows a sixth embodiment of the present invention in an external perspective view. As shown, the image recording apparatus has a body 75, buttons 76, a paper outlet 77, a paper presser 78, and a display panel 79. The display panel 79 shows which of the various replaceable parts should be replaced. Implemented with a liquid crystal display, the display panel 79 displays the arrangement of replaceable parts, i.e., drum 1, main charger 2, toner cartridge 3, developing unit 4, transfer charger 5, and cleaning unit 6, as shown in FIGS. 14 to 17. When the life of the toner cartridge 3, for example, expires, a particular part of the display panel 79 representative of the cartridge 3 becomes dark, as indicated by hatching in FIG. 14. This urges one to replace the toner cartridge 3. In the same manner, the display panel 79 informs a person of the time for replacing the parts having the same life, i.e., the chargers 2 and 5, the developing and cleaning units 4 and 6, or the drum 1, as shown in FIGS. 15, 16 or 17. Assume that an arrangement is made such that when a particular part having a comparatively long life has reached its life, other parts having a comparatively short life can be pulled out together with it. Then, only the part having a longer life may be displayed, i.e., the others having a shorter life and reached the time for replacement may not be displayed.

Figure 18:
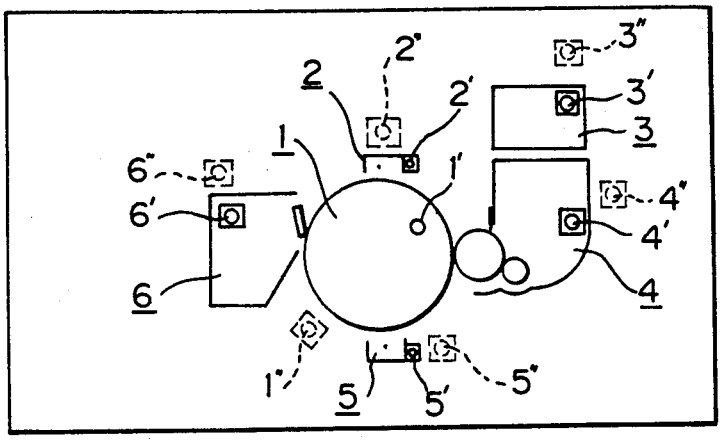
FIG. 18 is a view showing a seventh embodiment of the present invention.

FIG. 18 shows a seventh embodiment of the present invention which uses light emitting diodes (LEDs) or similar lamps 2', 2", 3', 3", 4", 4", 5', 5", 6' and 6" in place of the display panel 79 of the sixth embodiment. Specifically, the lamps 2' to 6" are affixed to the outermost ends of the individual replaceable parts or in close proximity to the same and are selectively turned on to indicate the time for replacement. Such visible display may be accompanied by audible indication implemented with a buzzer or a microphone, for example.

Figure 19:
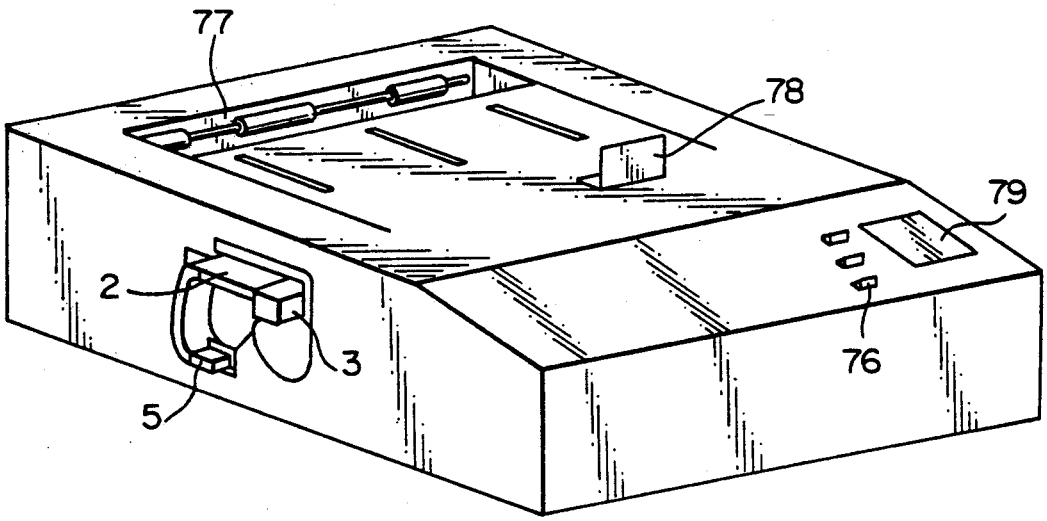
FIG. 19 is a perspective view of an eighth embodiment of the present invention.

FIG. 19 shows a eighth embodiment of the present invention which incorporates both the display panel 79 and the locking and unlocking mechanism shown in FIGS. 10 and 11. In this particular embodiment, the replaceable parts each is constantly biased in a direction in which it may be pulled out. Then, a part which needs replacement will be at least partly protruded from the equipment body 75.

Figure 20:
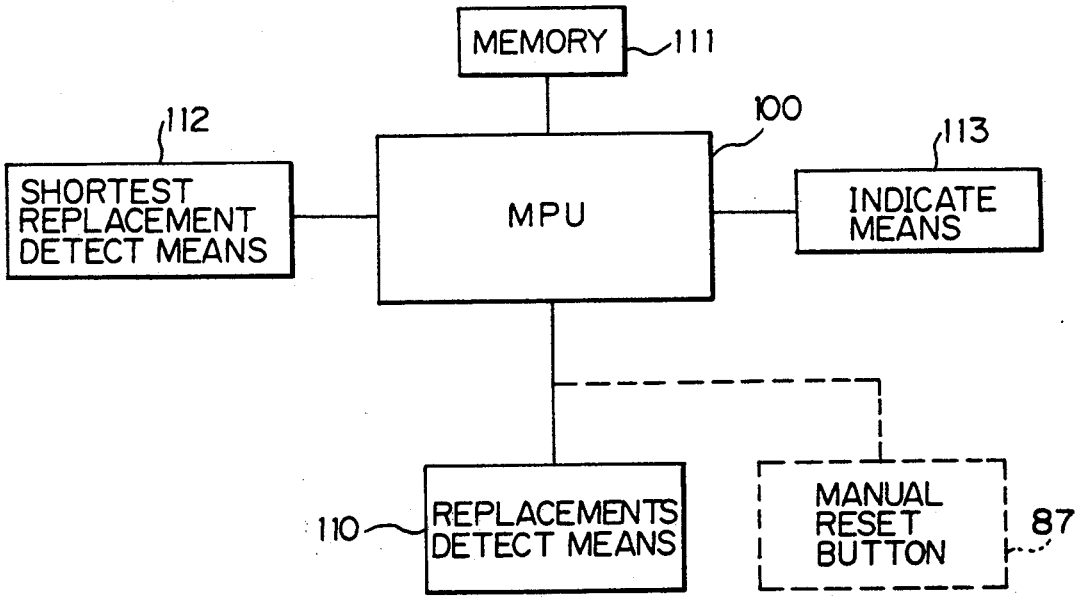
FIG. 20 is a schematic block diagram showing a specific construction of a replacement time indicating device applicable to the seventh and eighth embodiments.

The times for replacing the individual parts are detected and displayed, as follows. Assuming that the toner cartridge 3 has the shortest life by way of example, a microswitch, photosensor or similar replacements detecting means 110 shown in FIG. 20 determines the number of times that the toner cartridge 3 has been replaced, and the determined number of times is written to a memory 111 via the MPU 100. It is to be noted that the life of the toner cartridge 3 itself is determined by shortest replacement time detecting means 112 which may be comprised of a contact type sensor or remaining toner sensing means, for example. The lives of the replaceable parts other than the toner cartridge 3 are selected to be N times longer than the life of the toner cartridge 3 (N being a positive integer 1, 2, . . . ). When any of the count sequentially written to the memory 111 reaches N1, N2, . . . , NN, the MPU 100 causes indicating means 113 to urge a person to replace the associated part.

Figure 21:
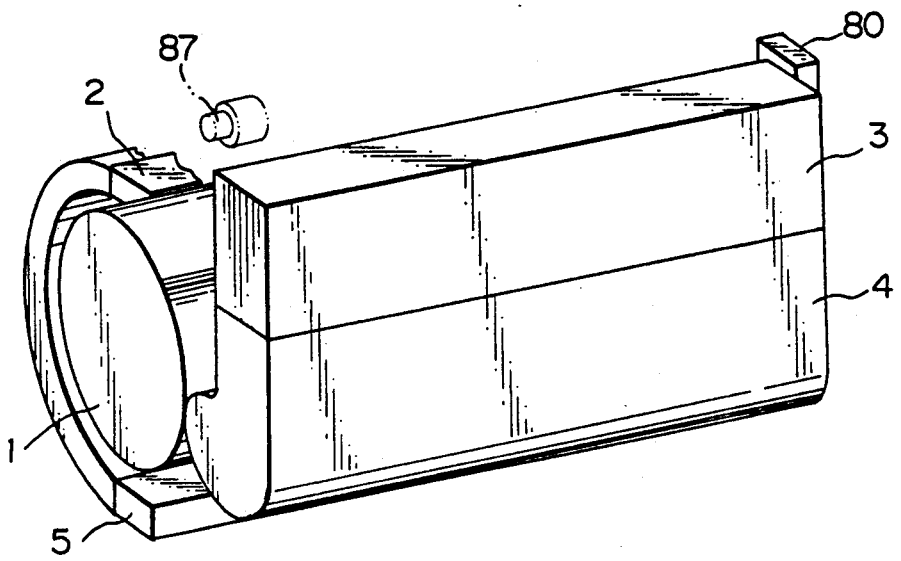
FIG. 21 is a fragmentary perspective view showing a specific configuration of replacement number detecting means included in the circuitry of FIG. 20 and which is implemented as electrical means.
Figure 22:
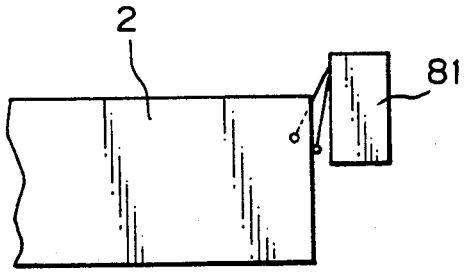
FIGS. 22 and 23 are views each showing another specific construction of the means of FIG. 21.
Figure 23:
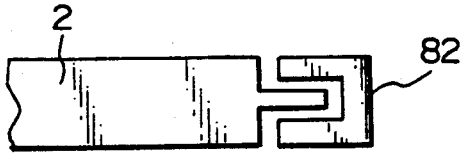

FIG. 21 shows a sensor 80 provided on the apparatus body and turned on or off every time the toner cartridge 3 whose life is shortest is replaced. The sensor 80 may be implemented with a microswitch 81 as shown in FIG. 22 or with a photosensor 82 as shown in FIG. 23. The microswitch 81 delivers an ON signal, an OFF signal and an ON signal in this order to the MPU 100 to inform the latter of the end of replacement of a particular part. Then, data associated with the replaced part is cleared or reset. As indicated by a phantom line in FIG. 21, a manual switch 87 may be substituted for the microswitch 81 or the photosensor 82 and located in close proximity to the toner cartridge 3. In this case, the operator will press the manual switch 87 on completing the replacement of the associated part.

Figure 24:
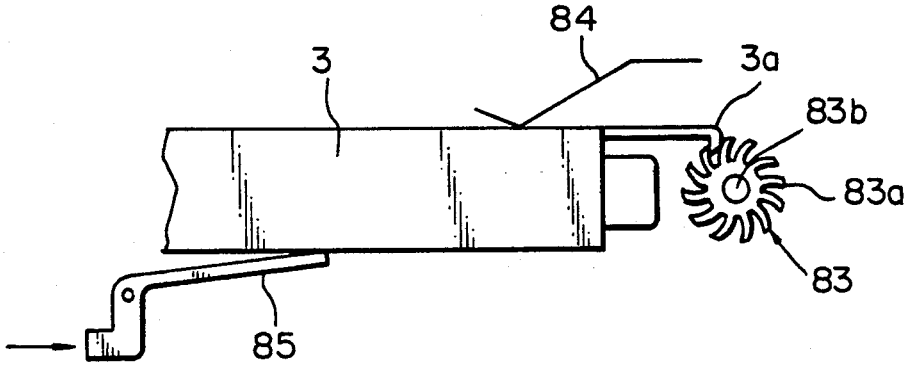
FIGS. 24 and 25 are views each showing particular mechanical means which is distinguished from the electrical means shown in FIGS. 21 to 23.
Figure 25:
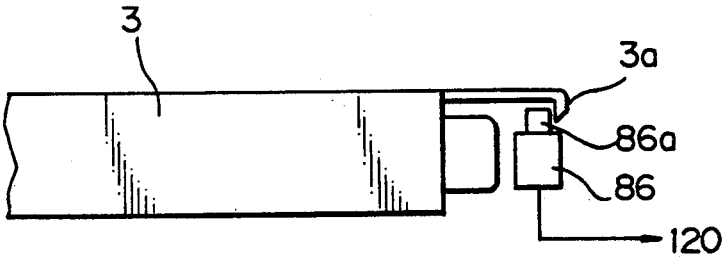

While the eighth embodiment relies on electrical means, i.e., the sensor 80 in determining the number of times that the part having the shortest life has been replaced, it may be replaced with mechanical means. FIGS. 24 and 25 show respectively a ninth and a tenth embodiment each using such mechanical mans. As shown in the figures, the toner cartridge 3 has a pawl 3*a*. In the ninth embodiment shown in FIG. 24, a wheel 83 having a number of teeth 83*a* is mounted on the apparatus body and rotatable clockwise through a one-way clutch. The teeth 83*a* of the wheel 83 are engageable with the pawl 3*a*. Every time the toner cartridge 3 is inserted into the apparatus body, its pawl 3*a* urges one of the teeth 83*a* of the wheel 83 and thereby rotates the wheel 83 by an angle associated with one tooth 83*a*. In this construction, the angular position of the wheel 83, i.e., a shaft on which the wheel 83 is mounted is representative of the number of times that the toner cartridge 3 has been replaced. Also mounted on the apparatus body are a leaf spring 84 and a push lever 85. The leaf spring 84 constantly urges the innermost end of the toner cartridge 3 downward, while the push lever 85 is accessible from the outside. When the push lever 85 is pushed in a direction indicated by an arrow in FIG. 24, it urges the innermost end of the toner cartridge 3 upward against the force of the leaf spring 84. Then, the pawl 3a is released from the teeth 83a to allow the toner cartridge 3 to be pulled out from the apparatus body.

In the teeth embodiment shown in FIG. 25, an electromagnetic clutch 86 is affixed the apparatus body. A rod 86a extending out from the clutch 86 is engaged with the pawl 3a of the toner cartridge 3 by the biasing force of the clutch 86, whereby the cartridge 3 is locked to the apparatus body. When the toner cartridge 3 should be replaced, the clutch 86 is energized to retract the rod 86a and thereby unlocks the cartridge 3. After the used toner cartridge 3 has been replaced with a fresh toner cartridge, the clutch 86 is deenergized to project the rod 86a thereof with the result that the fresh cartridge is locked to the apparatus body. Every time the clutch 86 is energized, a signal is fed to the MPU 100 to count the successive replacements of the toner cartridge 3.

The first to tenth embodiments described above each indicates and unlocks a part needing replacement by detecting such a part when the lift thereof expires. This procedure is satisfactory so long as a spare part is always at hand, as is usually the case with a toner cartridge. Regarding the other parts, however, it often occurs that no spare parts are available just at the time of replacement. In the light of this, assuming a particular part whose life is Ni times longer than that of the toner cartridge 3, when the cartridge 3 has been replaced Ni−1 times, the counting means, FIG. 20, causes the MPU 100 to drive the lamp or similar indicating means 113. This successfully informs the operator of the fact that the part of interest should be replaced in the even of the next replacement of the toner cartridge 3. Hence, a spare part for replacing the part of interest can be prepared well ahead of the time when the life of a toner cartridge will expire.

Predetermining the life of each replaceable part to be N times longer than the part whose life is shortest and setting the times for replacement of the parts having longer lives by determining the frequency of replacement of the part having the shortest life as described above has a problem, as follows. When the replaceable parts each is evaluated in terms of actual life as determined on a deterioration basis and not in terms of life as set by the counter, the life has a tolerance. For example, assume that all the toner cartridges have tolerances on the negative side relative to their predetermined life. Then, should a particular part whose life is Ni times toner than that of the toner cartridges be replaced at a predetermined time, the replacement would simply waste the remaining part of the life of the part. Conversely, assuming that all the toner cartridge have tolerances on the positive side relative to their predetermined life, the life of the above-mentioned part whose life is Ni would be short if it were replaced at the preset time. Moreover, the tolerance is substantially proportional to the life particular to a replaceable part, i.e., it increases with the increase in the life of a part.

Figure 26:
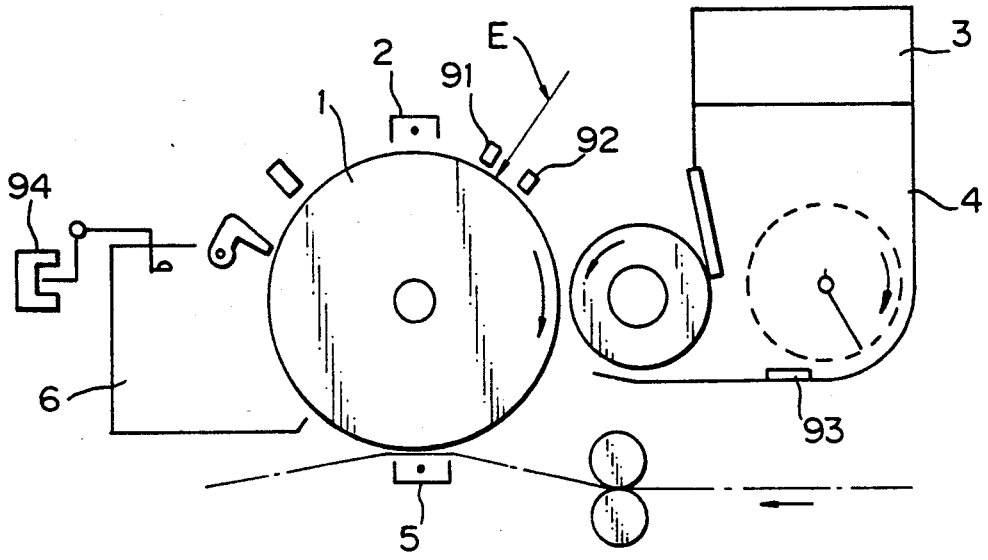
FIG. 26 is a view showing a specific configuration of a device for detecting the deterioration of particular replaceable parts.
Figure 27:
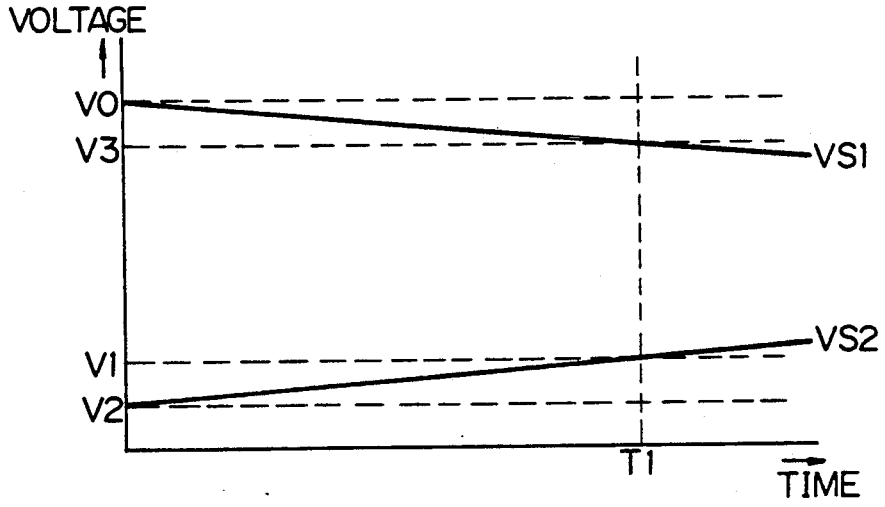
FIG. 27 ia s graph representative of the deterioration of particular replaceable parts.
Figure 28:
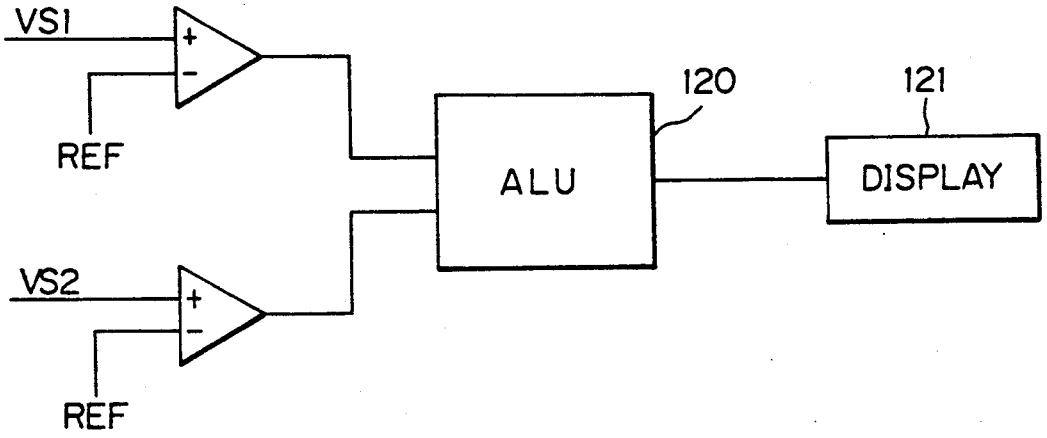
FIG. 28 is a schematic block diagram showing a specific construction of a deterioration determining device.

Preferably, therefore, the parts having comparatively short lives should be replaced on the basis of the number of times that the toner cartridge having the shortest life is replaced, while the parts having comparatively long lives should be replaced at particular times determined on a detected deterioration basis. FIG. 26 shows a specific arrangement for detecting the deterioration of the individual parts having comparatively long lives. As shown, regarding the drum 1 and main charger 2, electrostatic potential sensors 91 and 92 are located at opposite sides of an optical path for imagewise exposure E so as to measure potentials VS1 and VS2 (FIG. 27) before and after exposure. As shown in FIG. 27, a relation between the deterioration of the drum 1 itself and the potential of the sensors 91 and 92 is determined beforehand. FIG. 28 shows a deterioration determining and displaying device made up of an arithmetic and logical unit (ALU) 120 and a display 121. Assume that when the potential VS1 measured by the sensor 91 is lower than the initial value V0, the potential VS2 sensed by the sensor 92 is lower than a value V1, a represented by a time T1. Then, the device of FIG. 28 determines that the life of the drum 1 has expired. When the potential VS2 lies between the value V1 and a value V2 and the potential VS1 does not lie between the value V0 and a value V3, it is determined that the life of the main charger 2 has expired.

Figure 29:
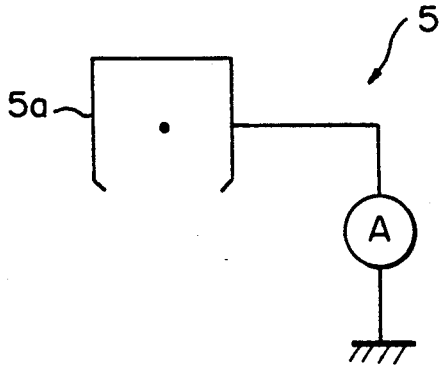
FIG. 29 is a diagram representative of specific circuitry for measuring the deterioration of a transfer charger.

FIG. 29 shows a specific implementation for detecting the deterioration of the transfer charger 5. As shown, the current flowing through the casing 5b of the transfer charger 5 is measured. When the current being measured decreases beyond a predetermined value, it is determined that the life of the transfer charger 5 has expired due to, for example, the contamination of the casing 5b of the deterioration of a charge wire. Further, the varying amount of a toner may be sensed by a piezoelectric element 93, FIG. 26, located at the bottom of a hopper included in the developing unit 4 or a photointerrupter 94, FIG. 26, associated with the cleaning unit 6.

By taking account of the actual degrees of deterioration, it is possible to eliminate wasteful replacement of parts and to thereby minimize the running cost.

While the illustrative embodiments have been shown and described in relation to an electrophotographic image recording apparatus, the present invention is similarly applicable to any other kind of apparatus having a plurality of replaceable parts.

In summary, the present invention achieves various unprecedented advantages, as enumerated below.

(1) Parts having the same life are integrally retained by common fixing means and, therefore, can be removed together by a single action. This promotes efficient replacement of various replaceable parts.

(2) A jig for replacement has engaging means for removing replaceable parts having the same life at the same time, while fixing means is not associated with the replaceable parts. Hence, replaceable parts having the same life can be removed at the same time only if the jig is configured adequately.

(3) A first part having a first life is removably mounted on a second part whose life is at least twice longer than the former. Therefore, the second part is automatically accompanied by the first part when pulled out.

(4) The present invention is applicable even to existing equipment since the above function (3) is implemented with a jig with no regard to the configuration of parts.

(5) Means for locking a replaceable part in position and means for unlocking it by determining that its life has expired is provided. This prevents parts which are still unable from being wastefully replaced with spare parts, while insuring the replacement of parts which should be replaced.

(6) The number of times that a part having the shortest life is counted to see if a part whose life is N times longer than the shortest life has reached the life thereof. Hence, an extremely simple arrangement suffices to detect the times for replacement of all of the replaceable parts.

(7) In addition to the above implementation (6), the parts whose lives have expired are displayed so that they can be seen at a glance and are, therefore, replaced without fail.

(8) A replaceable part N times longer in life than a part having the shortest life is detected and displayed when the count reaches N−1. A spare part for replacing such a part can, therefore, be prepared well ahead of time for replacement.

(9) When apart whose life has expired is fully replaced, the count and indication associated therewith are automatically reset. It follows that the tie for replacing a part having a comparatively long life can be corrected by measuring the actual deteriorations of such a part and, therefore, the wasteful replacement of a part whose deterioration is not noticeable is eliminated.

(10) In addition to the above implementation (9), subtracting means is provided for subtracting 1 (one) from the count resulted from resetting. Hence, a part the replacement of which has been postponed will be surely replaced later.

Various modifications will become possible for those skilled in the art after receiving the teachings of the present disclosure without departing from the scope thereof.

What is claimed is:

1. An apparatus comprising:

a plurality of replaceable parts each assigned a particular useful life, a first one of said parts being assigned a first life and a second one of said parts being assigned a second life which is an integral multiple of said first life;

first means for removing said first one of said parts;

second means for removing said second one of said parts;

wherein said first means is operable independently of said second means such that said first one of said parts is removable and replaceable without removing said second one of said parts;

wherein said second means is constructed such that said second one of said parts is not removable independently of said first one of said parts; and wherein said first means for removing comprises a first jig having a projection engageable with a recess in said first one of said parts, and wherein said second means for removing comprises a second jig having a first projection engageable with a recess in said first one of said parts and a second projection engageable with a recess in said second one of said parts.

2. An apparatus comprising:

a plurality of replaceable parts each assigned a particularly useful life, a first one of said parts being assigned a first life and a second one of said parts being assigned a second life which is an integral multiple of said first life;

first means for removing said first one of said parts;

second means for removing said second one of said parts;

wherein said first means is operable independently of said second means such that said first one of said parts is removable and replaceable without removing said second one of said parts;

wherein said second means is constructed such that said second one of said parts is not removable independently of said first one of said parts;

wherein said first means for removing said first one of said parts includes means for simultaneously removing an other one of said parts, said first one of said parts and said other one of said parts each having a useful life equal to said first life; and wherein said first means for removing comprises a first jig having a projection engageable with a recess in said first one of said parts and an another projection engageable with a recess in said other one of said parts, and wherein said second means for removing comprises a jig having projections engageable with recesses in said first one of said parts, said other one of said parts, and said second one of said parts, respectively.

* * * * *